US006106355A

United States Patent [19]

Hoerner

[11] Patent Number: 6,106,355

[45] Date of Patent: Aug. 22, 2000

[54] FLYING SAUCER WITH THROWING HANDLE

[76] Inventor: Steven Hoerner, 601 Maple St., East Aurora, N.Y. 14052

[21] Appl. No.: 09/263,157

[22] Filed: Mar. 5, 1999

[51] Int. Cl.[7] ..... A63H 27/00

[52] U.S. Cl. ..... 446/46; 473/588

[58] Field of Search ..... 446/34, 36, 37, 446/45, 46, 47, 48; 473/588, 589, 590

[56] References Cited

U.S. PATENT DOCUMENTS 3,673,732 7/1972 Liotta ..... 446/46
4,209,936 7/1980 Sklar .
4,606,125 8/1986 Jensen .
4,955,842 9/1990 Marcotti ..... 446/46
5,520,565 5/1996 Ulysse ..... 446/46

*Primary Examiner*—Sam Rimell
*Assistant Examiner*—Jeffrey D. Carlson
*Attorney, Agent, or Firm*—Crossetta & Associates

[57] ABSTRACT

This invention relates to an aerodynamic flying saucer throwing device which has a handle arranged to enable convenient gripping for convenient throwing of the device which automatically retracts upon throwing to provide a streamline silhouette wherein the handle is retracted from interfering in the flight and/or conventional catching of the saucer.

21 Claims, 5 Drawing Sheets

FLYING SAUCER WITH THROWING HANDLE

This invention relates to an aerodynamic flying disk type devices, particularly to a disk throwing device which has a retractable handle to enable convenient gripping by the user for convenient increased throw distance. The device has particular use as an aerodynamic toy to be thrown through the air in a variety of throwing games.

BACKGROUND OF THE INVENTION

Over the last several decades, throwing toys in the shape of round inverted disks or flying saucers as they have become commonly referred to, have become popular devices for use in throwing games and the teaching of aerodynamic principals. Such devices generally have a circular configuration and may have a rim arranged at its periphery. The rim is generally shaped as a trough approximating an airfoil, to provide aerodynamic characteristics so that it can be caused to glide or otherwise fly in a direction of throw, while exhibiting various in-flight maneuvers. Toys of such nature have been marketed for many years under the trademark Frisbee which is believed to be owned by Wham-O Mfg. Co.

The disk or saucer, is generally grasped with the fingers and thumb when in the act of throwing, using a wrist snapping motion to impart spin to the device and momentum in the direction of throw. The process of throwing requires a degree of skill on the part of the user and with appropriate practice the user can cause the device to accomplish various aerodynamic maneuvers and glide over substantial distances.

The prior art is replete with various proposed improvements to flying disk devices. U.S. Pat. No. 3,724,122 discloses an embodiment of a flying saucer disk comprising refined shapes of a saucer with an aerodynamic rim, which are said to provide greater gliding capabilities and enable greater throwing distances for the saucer.

U.S. Pat. No. 4,233,952 discloses a hand held catapult device comprising a handle and yoke arrangement wherein the yoke engages a disk. The disk is held in a biased position, which upon snapping the handle in a throwing motion releases the saucer to impart spin and momentum to the disk. The device is effective in launching the disk but requires mounting the disk for each instance of throwing and the carrying of a separate bulky apparatus for effective use.

U.S. Pat. No. 4,347,828 discloses a hand held catapult device similar to the foregoing comprising a handle and basket arrangement wherein the basket cradles a flying saucer type disk. The saucer is held in a biased position and upon snapping the handle in a throwing motion, releases the saucer to impart spin and momentum to the saucer. As with the previous patent, the device is effective in launching the saucer or disk but requires mounting the saucer for each instance of throwing and the carrying of a separate bulky apparatus for continuous game use.

U.S. Pat. No. 5,125,862 provides a device wherein a saucer type disk is centrally mounted over a pivot knob, the pivot knob is rotated by a hand held motorized unit to impart spin to a saucer so that the saucer can be launched. This device is effective in imparting spin to the saucer, but does not appear to be effective for imparting throwing momentum over long distances.

U.S. Pat. No. 4,040,625 discloses a device comprising a ring to be worn on a finger of a user and has a shaft extending from the ring. The shaft has a rounded tip for catching a spinning saucer having a rim and has a roller spaced down the shaft for engaging the rim of the spinning saucer to enable the saucer to be maintained spinning by the user. The device does not appear to provide any added benefit to throwing momentum regarding the disk.

The devices of the above prior art disclosures appear to be inconvenient to the user in imparting forward momentum in that they require the carrying and handling of separate devices when throwing a disk. They require mounting the disk to the apparatus in each instance of use and appear to be disruptive of the continuity of many throwing games in which the disk might be used.

It is an object of the present invention to provide a means for augmenting the throwing of disk type devices.

It is another object of the present invention to provide a throwing means which is an integral part of a disk and which can be conveniently used by the catcher of the disk to throw the disk again.

It is a further object of the present invention to provide a handle means on the saucer which can be conveniently used to grasp the disk for throwing.

It is a still further object to provide a handle on a flying disk which can be used to grasp the disk for throwing and which retracts to a non-interfering position after launch.

These and other objects of the invention will be apparent from the following description of the invention.

SUMMARY OF THE INVENTION

In its most general embodiment, the present invention comprises a disk shaped device comprising a handle which extends outwardly from the periphery of the disk for gripping by the user to effect throwing, which handle automatically retracts from its extended position upon leaving the hand of the user throwing the device. By disk, is meant any generally circular shaped object intended to be launched for flight, whether or not it is flat on one or both sides, or is shaped as for example as a saucer, with or without a peripheral rim or the like to promote flying. By interior to/of the disk is meant the surface and/or space adjacent the surface area of a side of the disk, as for example the surface and/or space adjacent the surface area defined by the periphery of a disk, with or without a peripheral rim.

The handle comprises an elongate member having an interior end and an opposite gripping end, which handle is mounted to a support member positioned interior to the disk and is enabled to move axially from an extended to a retracted position on a radius through about the central axis of the disk. In the extended position, the gripping end of the handle protrudes from about the periphery of the disk an amount sufficient to be grasped by the user. In the retracted position, the handle is positioned generally interior to the disk, preferably at least sufficient to have no significant portion of the gripping end of the handle protruding from about the periphery of the disk.

The support member is mounted along the surface area interior to the disk and comprises means for coacting with the elongate handle. In a preferred arrangement of the invention, the handle comprises an elongate slot by means of which it is slidably mounted to the support member to be axially movable through at least a portion of its length. A handle guide is spaced radially outward from the support member and is arranged to guide the handle through at least a portion of its axial movement. Thus, the support member, handle guide and elongate slot coact to define axial movement of the handle along about a radius of the disk and resist rotational movement of the handle around the central axis of the disk.

The support member can be arranged at about the central axis of the disk or offset therefrom. The slot of the handle is generally arranged and sized so that upon retraction of the handle, the mass of the handle from the support member to the interior end of the handle is balanced in respect to the support member and remaining handle mass, to maintain the center of mass of the spinning disk at about the central axis thereof. In a preferred embodiment, the support member is positioned offset from the central axis of the disk, the slot of the handle is arranged and sized so that upon movement of the handle to its retracted position, the mass of the handle extending from the support member to the interior end of the handle is balanced to provide a counter mass to the offset support member and mass of the handle to its opposite gripping end, and create a center of mass of the disk at about the central axis when the disk is spinning. Applicant has found that such embodiment is particularly effective in producing flying effects which do not appear to be characteristic of other spinning disks.

The handle guide can be located interior to the periphery or at the periphery of the disk, but generally is not arranged to extend from the periphery to maintain the streamline construction of the disk. In a preferred embodiment, the disk is in the shape of an inverted saucer, comprises an aerodynamic rim at its periphery and the handle guide constitutes an opening in the rim through which the handle extends and retracts. In such embodiment, the opening may be configured such that when the handle is in either the extended or retracted position, the rim surrounding the opening engages along the handle to resist rotational movement of the handle around the central axis of the disk. In another embodiment, the opening may be configured such that when the handle is in the extended position, the rim surrounding the opening engages along the handle to resist rotational movement thereof, but when the handle is in a retracted position, there is no engagement with the rim.

It is generally desirable to have the handle retract almost immediately upon release of the opposite end from the grip of the user during throwing. Generally, the handle can be appropriately counter balanced and the positioning and length of the slot sized so that the upon release of the handle with a spinning action imposed upon the disk, centrifugal forces imposed upon the slidably mounted handle force the handle to move axially along the slot to an end of the slot dimensioned to represent a balanced position of the handle around the central axis. In a preferred embodiment, urging means are arranged to urge retraction of the handle and assure balanced positioning of the handle upon release of the gripping end from the grip of the user. Various urging means can be used in the invention without departure from the spirit of the invention. Generally, it is preferred to use spring, elastomeric and the like means for urging the handle toward the interior area of the disk. Any suitable arrangement of urging means can be used, such as for example pushing or pulling the handle into a retracted position using any suitable surface of the disk, support member, handle and/or guide means to urge from and/or against. In a preferred embodiment, it is desirable to lighten the weight of the disk, so the handle is hollow, and a lightweight elastomeric band is mounted at one end to the handle along the hollow and at its other end looped around or otherwise mounted to the support member. The elastomeric band is assembled to the arrangement in a slightly stretched state such that it maintains some retracting urging force upon the handle even when the handle has reached the limit of its fully retracted state. When the handle is extending, the elastomeric band exerts an increasing retraction urging force upon the handle. Thus, immediately upon release of the handle from the grip of the user, the elastomeric band urges the handle to a fully retracted position whether or not the disk is spinning.

In a most preferred embodiment, the support member comprises a cylindrical or conical base member extending from the surface of the disk. The handle is hollow and has a generally elliptical cross section with opposing sides. One side of the handle comprises an elongate axial slot, and the hollow of the handle comprises means for mounting an elastomeric band along its length toward the opposite gripping end. The base member is topped with spaced opposing annular rings which form an annular slot therearound, in which an elastomeric band can be mounted. The annular rings have a diameter which is greater than the width of the elongate slot on the side of the handle, but are dimensioned so that they can be passed through the slot of the handle by manipulating the handle during mounting to the support member. In one embodiment, the slot is enlarged at an end for convenient manipulation of the rings through the slot.

Generally, the close fit and manipulated mounting of inner annular ring through the elongate slot is sufficient to resist detachment of the handle during use. In a further embodiment, the base member may further comprise slots on opposite sides thereof which are spaced inwardly from the annular rings topping the base member. It should be understood that such slots may comprise a continuous slot around the base member. The opposing slots in the base member are sized to engage the edge of the sides defining the slot in the handle and are configured to enable removably and slidably mounting the slotted side of the handle to the base member. The resulting arrangement enables the handle to be easily assembled to the base member. Generally, the assembly of the handle over the annular ring top of the base member is accomplished with commensurate assembly of the elastomeric band, in such manner that inner annular ring and/or the edges of the slot of the handle engaging along the opposing slots of the base member during axial movement of the handle resist disassembly of the handle.

DESCRIPTION OF THE PREFERRED EMBODIMENT

Figure 1:
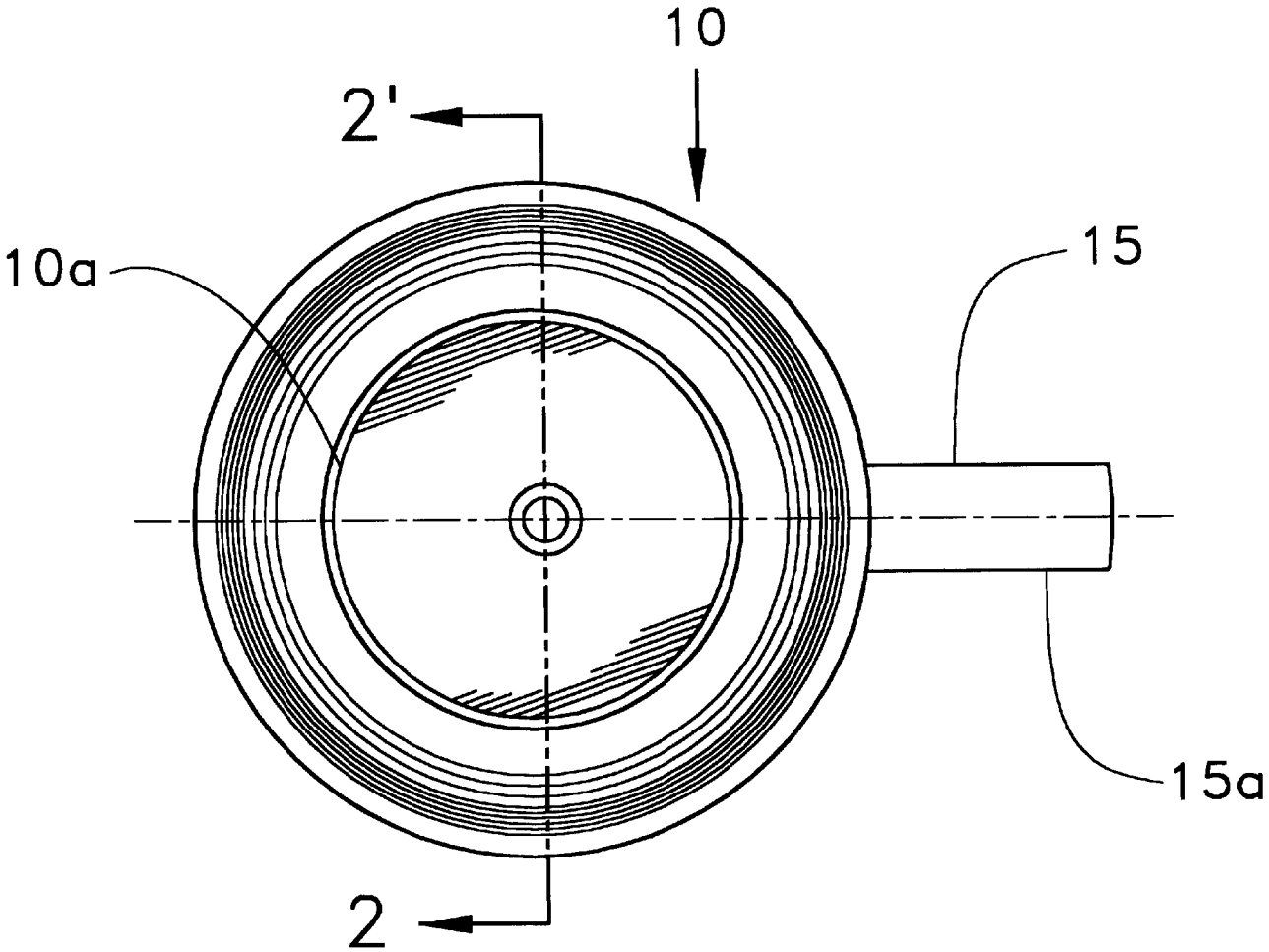
FIG. 1 is a top plan view of one embodiment of the device of the invention, with gripping end of the handle extended.

Referring now to the drawings, FIG. 1 illustrates an embodiment of the invention wherein a saucer shaped disk 10, having top surface 10*a* is illustrated comprising gripping end 15*a* of handle 15 in extended position from the periphery of the saucer, in an arrangement to be thrown.

Figure 2:
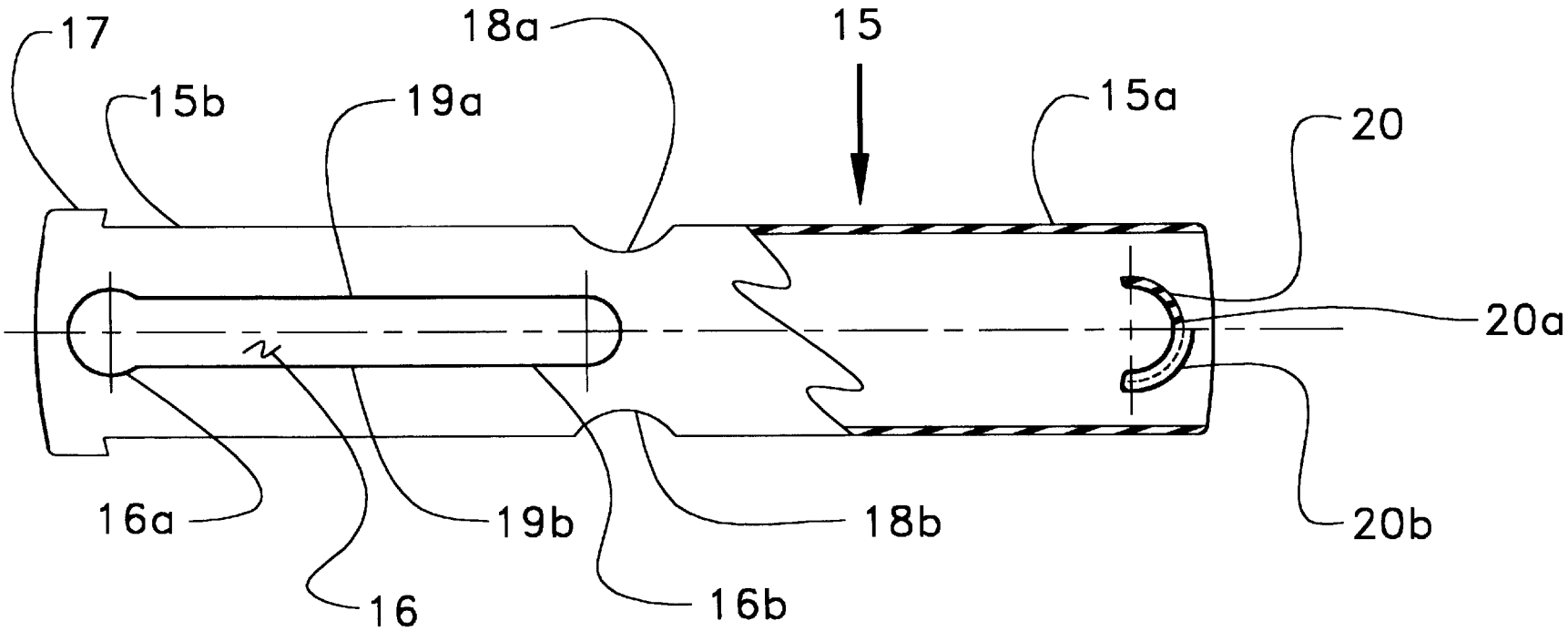
FIG. 2 is a partial sectional, top view of the handle of the device of FIG. 1.

FIG. 2 illustrates hollow handle 15 as comprising gripping end 15*a* shown in section, and interior end 15*b*. Elongate slot 16 is illustrated as comprising ends 16*a* and 16*b*, the slot having generally parallel opposing edges 19*a* and 19*b* and enlarged circular opening at end 16*a* to enable convenient manipulation of the handle 5 over the annular rings of the support member. Interior end 15*b* of the handle is shown as comprising balance mass 17 and finger grips 18*a* and 18*b*. Balance mass 17 is sized and weighted so that the mass of handle 15 extending from an offset support member to interior end 15*b* of the handle is balanced to provide a counter mass to the mass of the offset support member and mass of the handle to its opposite gripping end 15a, and creates a center of mass of the disk at about the central axis when the disk is spinning. Finger grips 18*a* and 18*b* enable convenient handling of the handle for moving same to an extended position for throwing.

Gripping end 15*a* is shown in section as comprising an elastomeric band mounting means 20, which is molded to the interior of bottom side of hollow handle 15, and comprises a rounded shoulder 20*a* having a retaining lip 20*b*. During the assembly of the handle to the device of the invention, the elastomeric band is looped around rounded shoulder 20*a* and is retained in place in the space between the interior surface of the bottom side of handle 15 and retaining lip 20*b*, with the other end of the elastomeric band being mounted around the slot formed by the retaining rings topping the support member.

Figure 3:
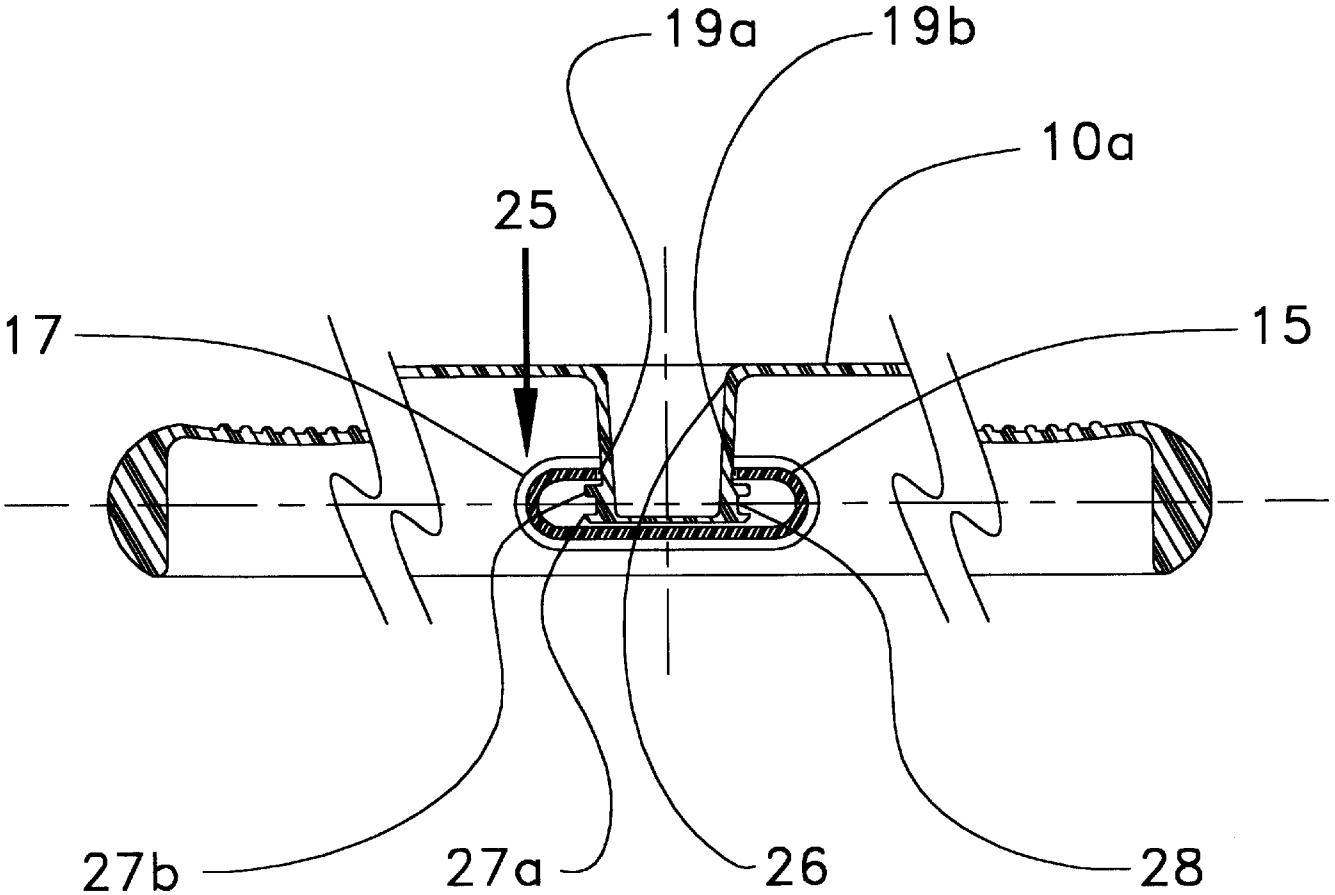
FIG. 3 is a fragmented sectional view of the device of FIG. 1 taken along about line 2–2'.

FIG. 3 illustrates the relationship among the support member and the handle. Therein, support member 25 is illustrated as being a generally cylindrical structure which extends from the interior surface of saucer disk 10. Base element 26 is shown as being topped by opposing annular rings 27*a* and 27*b*, forming elastomeric band mounting slot 28. In the illustrated embodiment, support member 25 is a molded structure contiguous with the disk, the a annular rings being integrally molded therein to form the slot. Handle 15 is shown as being generally of an elliptical shape with edges 19*a* and 19*b* of elongate slot 16, engaging the surface of the base element below inner annular ring 27*b* to provide a secure mounting to the support element.

Figure 4:
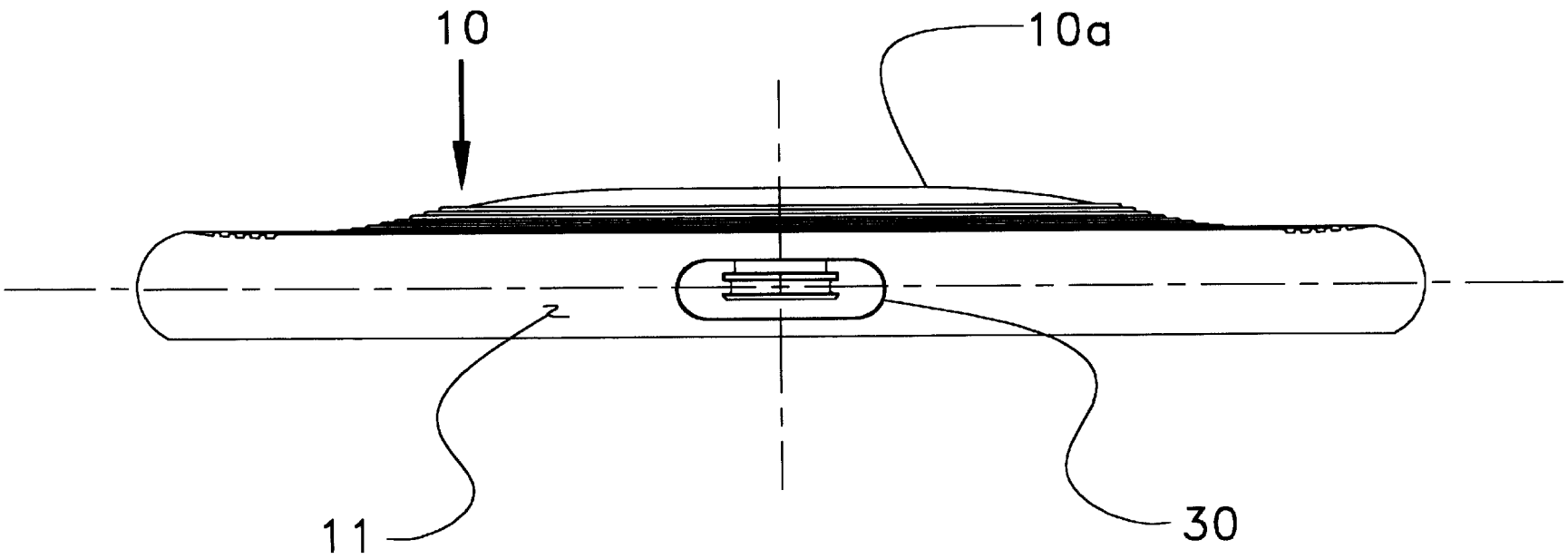
FIG. 4 is a right side plan view of the device of FIG. 1 with handle assembly removed.

FIG. 4 illustrates a handle guide of the invention, wherein handle guide 30 is illustrated as comprising an opening in rim 11 of saucer 10. The handle guide opening is shaped and sized to enable the close passage of the gripping end 15*a* of handle 15 therethrough, without significantly restricting automatic retraction thereof, yet resist movement of the handle rotatably around about the central axis of the saucer.

Figure 5:
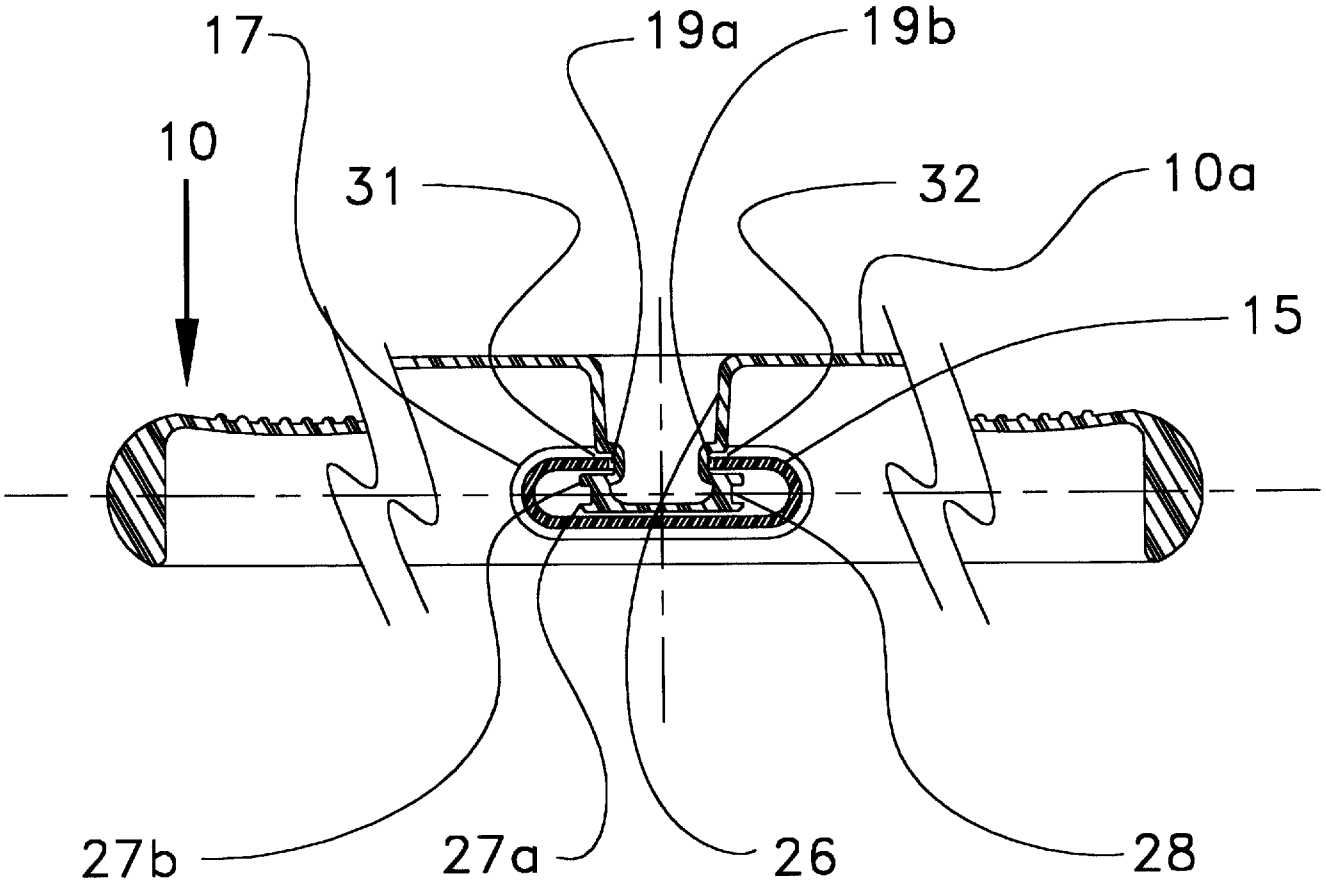
FIG. 5 is a fragmented sectional view of a device of FIG. 1 taken along about line 2–2', wherein the base member is slotted to engage an elongated slot of a handle.

FIG. 5, illustrates an embodiment of the support member of the invention wherein the base member 26 comprises a slotted arrangement positioned to engage the edges of the elongate slot in the handle. In this embodiment slots 31 an 32 are molded into the base member and are sized to accept edges 19*a* and 19*b* of the sides of the elongated slot of the handle to provide added resistance to disassembly of the handle from the support member and provide additional guidance and support of the handle during extension and retraction movement.

While certain present preferred embodiments have been shown and described, it is distinctly understood that the invention is not limited thereto but may be otherwise embodied within the scope of the following claims.

I claim:

1. A disk, adapted to be thrown through the air and having an aerodynamic surface for gliding, said disk comprising an elongate handle arranged radially to a central axis of said disk, said handle having first and second ends and being slidably mounted to said disk in an arrangement wherein said handle is slidably movable axially along about its axis from a first position wherein said first end is extended beyond about the periphery of said disk to a second position wherein said first end is retracted from the extended position.

2. The disk of claim 1 in the shape of a saucer.

3. The disk of claim 2 wherein the saucer shaped disk comprises a circular crown portion at about its central axis.

4. The disk of claim 1 wherein said handle is arranged to automatically retract from said extended position.

5. The disk of claim 1 wherein said elongate handle slidably mounts to a support member arranged along a side of said disk.

6. The disk of claim 5 wherein said handle comprises an elongate slot and said support member engages said handle by means of said slot to enable axially slidable movement of said handle through at least a portion of its length.

7. The disk of claim 5 comprising a handle guide, spaced from said support member and arranged to guide said handle during axial movement thereof.

8. The disk of claim 7 wherein said disk comprises a rim arranged at about its periphery.

9. The disk of claim 8 wherein said handle guide comprises an opening in said rim.

10. The disk of claim 4 comprising means to urge said handle to a retracted position.

11. The disk of claim 10 wherein said means to urge said handle is selected from spring and elastomeric means.

12. The disk of claim 6 comprising urging means, arranged among said support member and said handle, said urging means being arranged to urge said handle to a retracted position.

13. The disk of claim 12 wherein said support member comprises spaced opposing annular rings which form a slot arranged for mounting an elastomeric band urging means.

14. The disk of claim 13 wherein said elongate handle comprises means for mounting said elastomeric band to said handle, said means for mounting being arranged to oppose said slot and enable said elastomeric band to urge said handle to a retracted position.

15. The disk of claim 14 wherein said elongate handle is hollow and comprises said means for mounting said elastomeric band within said hollow.

16. The disk of claim 13 wherein said elongate slot of said handle is sized and dimensioned to enable mounting said handle over said annular rings of said support member.

17. The disk of claim 1 wherein said second end of said handle is arranged to balance the center of mass of the disk at about the central axis when the disk is spinning.

18. The disk of claim 5 wherein said support member is arranged offset from the central axis of said disk.

19. A disk, shaped in about the form of an inverted saucer and adapted to be thrown through the air, comprising:

an elongate hollow handle arranged radially to a central axis of said disk, said handle having first and second ends and comprising an elongate slot arranged for mounting said handle to said disk in enabled slidable movement radially of said disk;

a support member, arranged along the inverted side of said disk, said support member comprising means for mounting said handle and coacting with said elongate slot to enable slidable movement of said handle axially from a first position wherein said first end of said handle is extended beyond about the periphery of said disk to a second position wherein said first end is retracted from the extended position;

a handle guide, spaced from said support member and arranged to guide said handle during axial movement thereof; and urging means, arranged to urge said handle axially from said first position to said second position.

20. The disk of claim 19 wherein said disk comprises a peripheral rim, said handle guide comprises an opening in said rim through which said handle is extended to said first position, said support member is arranged offset from the central axis of said disk and said handle comprises means for balancing the center of mass of the disk at about the central axis when the disk is spinning.

21. The disk of claim 20 wherein said urging means coacts among said support member and said handle to urge said handle to a retracted position.

* * * * *